United States Patent [19]

Leyden et al.

[11] Patent Number: 4,588,609

[45] Date of Patent: May 13, 1986

[54] PROCESS FOR THE PHOTOCHEMICAL VAPOR DEPOSITION OF AROMATIC POLYMERS

[76] Inventors: Richard N. Leyden, 22024 Alta Dr., Topanga, Calif. 90290; James T. Hall, 1419 S. Irena Ave., Redondo Beach, Calif. 90277

[21] Appl. No.: 674,619

[22] Filed: Nov. 26, 1984

[51] Int. Cl.[4] ..... B05D 3/06

[52] U.S. Cl. ..... 427/54.1; 252/500; 522/1; 522/66

[58] Field of Search ..... 427/53.1, 54.1; 252/500; 549/13; 428/419; 204/159.11

[56] References Cited

U.S. PATENT DOCUMENTS 3,271,180 9/1966 White .
3,518,111 6/1970 Wright et al. ..... 427/54.1
4,330,570 5/1982 Giuliani et al. .

OTHER PUBLICATIONS

Yamamoto et al., *Bull. Chem. Soc. Jap.*, vol. 51, 1978, pp. 2091–2097.
Kovacic et al., *J. Am. Chem. Soc.*, vol. 85, 1963, pp. 454–458.
Kovacic et al., *J. Org. Chem.*, vol. 29, 1964, pp. 100–104.
Ivory et al., *J. Chem. Phys.*, vol. 71, 1979, pp. 1506–1507.
Carchano, *J. Chem. Phys.*, vol. 61, 1974, pp. 3634–3643.
Mori, *Science*, vol. 208, 1980, pp. 819–825.
Hentz & Burton, "Studies in Photochemistry and Radiation Chemistry of Toluene, Mesitylene and Ethylbenzene", *J. Amer. Chem. Soc.*, vol. 73, 1951, pp. 532–536.
A. N. Wright, chapter 8, "Photopolymerization at Surfaces", in *Polymer Surfaces*, Clark and Feast, ed., John Wiley & Sons, New York, pp. 155–183.
Shacklette et al, "Solid-State Synthesis of Highly Conductive Polyphenylene from Crystalline Oligomers", *J. Chem. Phys.*, vol. 73, No. 8, Oct. 15, 1980, pp. 4098–4102.

*Primary Examiner*—John H. Newsome

[57] ABSTRACT

A low-temperature process for forming a thin film of an aromatic polymer on the surface of a substrate by exposing the substrate to a monomer precursor containing arylene groups in the presence of radiation of a selected wavelength. Upon radiation inducement, the monomer units interact to form a polymer comprising directly bonded repeating arylene groups, and the polymer deposits as a layer on the substrate. Optionally, the polymer layer may be simultaneously or subsequently doped to provide a conductive polymer layer. Specifically disclosed polymers are polyparaphenylene and its antimony pentafluoride-doped derivative. The former is useful as a dielectric insulator or passivation material in semiconductor devices and circuits, while the latter is useful in batteries and solar cells, or electromagnetic shielding.

14 Claims, No Drawings

PROCESS FOR THE PHOTOCHEMICAL VAPOR DEPOSITION OF AROMATIC POLYMERS

BACKGROUND OF THE INVENTION

1. Field of the Invention

The present invention relates generally to a process for forming polymers comprising directly bonded arylene groups, and, more particularly, to a photochemical vapor deposition process for depositing thin layers of such polymers on a substrate.

2. Description of the Background Art

A variety of dielectric or insulating materials are used in the fabrication of semiconductor devices and circuits to provide a layer of electrical insulation between adjacent conductive areas. In addition, such materials are used to provide a surface passivation layer to protect substrate surfaces or to provide a mask for selective processes such as etching or ion implantation. Typical materials used include silicon dioxide, silicon nitride, polyimides and polymers of the polyphenylene class of compounds.

A known method for forming polyparaphenylene is by the reaction in solution between p-dibromobenzene and magnesium and $NiCl_2$(bipyridine), as described, for example, by T. Yamamoto, Y. Hayashi, and A. Yamamoto in *Bul. Chem. Soc. Jap.*, Vol. 51, 1978, at page 2091. Another known method for forming polyparaphenylene is by the oxidative cationic polymerization of benzene as described by P. Kovacic and A. Kyriakis in *J. Am. Chem. Soc.*, Vol. 85, 1963, at page 454 and by P. Kovacic and J. Oziomek, in *J. Org. Chem.*, Vol. 29, 1964, at page 100. The product of these methods is a brown infusible powder which must be sintered at a temperature above 300° C. and under increased pressure to form it into the desired shape. However, the sintering process tends to degrade the polymer and the resulting product has less than the theoretical maximum density, resulting in loss of contact between particles and decrease in electrical conductivity. The latter property is important for forming conductive polymers, as discussed immediately below. Moreover, since the polymers must be pressed into the desired shape it is not possible to form very thin films which conform to the substrate.

In addition, it has recently been proposed to dope polyparaphenylene to produce a conducting polymer, as described, for example, by D. M. Ivory et al, in *J. Chem. Phys.*, Vol. 71, 1979, at page 1506. These conducting polymers can be used in lightweight batteries, such as for an all-electric automobile, in solar cells, as wire and cable sheathing, and as electromagnetic shielding. However, progress in this area has been limited by the above noted fabrication difficulties associated with polyparaphenylene.

Thus, the need exists for a low-temperature process for forming polyparaphenylene. Further, there exists a need for a process for forming thin films of polyparaphenylene having desirable physical and electrical properties for the applications discussed above.

SUMMARY OF THE INVENTION

The general purpose of the present invention is to provide a new and improved process for depositing a layer of a polyarylene material on the surface of a substrate by a low-temperature photochemical vapor deposition reaction. This process possesses most, if not all, of the advantages of the prior art processes while overcoming their above mentioned significant disadvantages.

The above described general purpose of this invention is accomplished by exposing the substrate to a vapor phase reactant which is the monomer precursor containing arylene groups in the presence of radiation of a selected wavelength. Upon radiation inducement, the monomer units interact to form a polymer comprising directly bonded repeating arylene groups, and the polymer deposits as a layer on the substrate. Optionally, the polymer layer may be simultaneously or subsequently doped to provide a conductive polymer layer.

Accordingly, it is a specific purpose of the present invention to provide a low-temperature process for depositing a polyarylene layer on a substrate without producing thermal damage to the substrate.

Another purpose is to provide an insulator layer for a semiconductor device, in which the layer exhibits good insulating properties and good step coverage.

Yet another purpose is to provide a passivation layer for microelectronic devices and circuits, in which the layer has uniform thickness and provides a good conformal coating.

Another purpose is to provide a low-temperature process for forming a thin film of polyparaphenylene on a substrate.

A further purpose of the present invention is to provide a low-temperature process for forming a layer of a conductive polymer on a substrate.

The above described and many other features and attendant advantages of the present invention will become better understood by reference to the following detailed description of the invention.

DETAILED DESCRIPTION OF THE INVENTION

In accordance with a first process embodiment of the present invention, a layer of a polyarylene material is formed on the surface of a substrate by exposing a monomer precursor containing the arylene unit to radiation of a selected wavelength to generate neutral monomeric units which then combine to form the polyarylene compound. More particularly, in accordance with the present invention, a substrate is exposed to vapors of p-dibromobenzene and irradiated with radiation of a predetermined wavelength. While not limiting the present invention to a particular theory of operation, it is believed that the photonic energy absorbed by the monomer generates neutral monomeric units which combine to form polyparaphenylene, as suggested schematically in equation (1). Although the exact mechanism and intermediate steps are unknown at this time, it is believed that each bromine atom in the precursor may require one photon for cleavage.

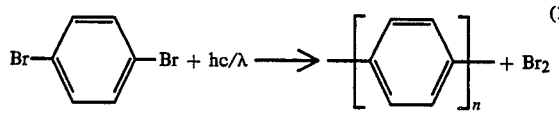

(1)

where h=Planck's constant c=speed of light

λ=wavelength of absorbed radiation n=degree of polymerization

In addition, the actual reaction mechanism may involve intermediate structures such as gas or surface phase radicals. One suitable wavelength of radiation is at 1849 angstroms (Å), such as produced by a low pressure mercury vapor lamp.

An apparatus suitable for carrying out the above described process is set forth in U.S. Pat. No. 4,371,587, which is modified to provide for the formation of the vapor phase reactant from a solid or liquid material. In the case of p-dibromobenzene, the crystals may be placed in a vial which is covered with a porous plug of glass wool to hold the crystals within the vial, but allowing the vapor to escape. The vial may be adjacent to or attached to the substrate holder, with the opening of the vial about one inch from the substrate. The reaction chamber is evacuated to less than 0.1 torr or other suitable pressure which is below the pressure at which the monomer vapor condenses to a solid or liquid. The vial is heated to about 85° C. to produce vapors of p-dibromobenzene. The pressure in the reaction chamber is adjusted to an operating pressure of about 0.05 to 1 torr (7 to 150 pascals) by adjusting the throttle valve connected to the pump. Once the system stabilizes, the ultraviolet lamps are turned on to initiate the photochemical reaction.

Other suitable monomers include dihalogenated benzene compounds substituted with chlorine or iodine since the chlorine-carbon bonds and iodine-carbon bonds can also be readily cleaved by 1849Å radiation. Because of the relative bond strengths and ease of dissociation, an iodine substituent is most preferred in the practice of the present invention, followed, in turn, by bromine and chlorine. By contrast, it has been found that fluorine-carbon bonds are not as easily broken, nor are carbon-carbon double bonds or conjugated bonds. Thus, the process of the present invention may be used to selectively break certain bonds while leaving others intact to provide a polymer product with pendant groups, such as fluorine or alkene groups, on the aromatic ring. Additional suitable monomers include certain di-substituted benzene compounds, or other substituted aromatic compounds in which the substituent can be removed by photolysis as described above and which have sufficient vapor pressure to accomplish the desired reaction within a reasonable period of time. Compounds comprising other arylene groups besides phenylene may also be used, such as groups derived from naphthalene, anthracene, and biphenyl, provided they have the necessary vapor pressure. The term "arylene" is used herein to designate the group formed by removing two hydrogen atoms from an aromatic group. Further, meta- as well as para-substituted monomers may be used, and in certain cases meta-substitution may be preferred. In addition, it is anticipated that certain monosubstituted aromatic compounds may be used as the monomer precursor, in which case both the substituent and one hydrogen atom may be removed from the aromatic group to provide a reactive radical as previously described herein. Moreover, a mixture of monomer precursors containing various arylene groups may be used to provide the corresponding mixed polymers. Finally, any of the above noted monomers may be substituted with one or more chosen pendant groups which remain intact in the polymer product. Thus, the monomer precursor provides the repeating arylene groups which are directly linked together in the final product.

The monomer precursor is provided in the reaction chamber as a vapor phase reactant. A vapor phase monomer is introduced into the reaction chamber under the control of a flow meter to provide a predetermined amount of monomer. For a solid or liquid monomer, the solid or liquid may be heated to a predetermined temperature in a container external to the reaction chamber to produce a desired vapor pressure, and vapors are then introduced into the reaction chamber either driven by force of their own vapor pressure or swept by an inert carrier gas, such as nitrogen or argon, under control of a flow meter. In order to prevent condensation of the vapor, it may be necessary to heat tubing through which the vapors pass in route to the reaction chamber. Optionally, the solid or liquid monomer may be placed in a container in the reaction chamber, in close proximity to the substrate, and heated to a predetermined temperature to produce the desired vapor pressure of the monomer. Thus, the partial vapor pressure of the monomer in the reaction chamber can be accurately and reproducibly controlled by controlling the temperature of the monomer solid or liquid.

The substrate for the process of the present invention may be, for example, a silicon wafer, a glass slide, a metallized surface, a ceramic component, or any substrate formed of a material that is compatible with the reaction conditions specified herein.

Further, in accordance with the first process embodiment of the present invention, the monomer precursor may be dissociated by an indirect or sensitized photolysis using mercury vapors as a photosensitzer in conjunction with a suitable radiation source, such as a low pressure mercury vapor lamp. As is known in the art of photochemical vapor deposition, radiation at 2537Å from an external low pressure mercury lamp is absorbed by mercury vapor to produce mercury vapor in an excited state (Hg*), as shown in equation (2) below. While not limiting the present invention to a particular theory of operation, it is believed that the Hg* then interacts with the monomer precursor, such as p-dibromobenzene, and transfers energy to the monomer to produce neutral monomeric units which combine to form the polymer, such as polyparaphenylene, as suggested schematically in equation (3). Although the intermediate steps and mechanisms are not known at this time, it is believed that each bromine bond in the precursor may require one Hg* for cleavage.

$$Hg + hc/\lambda(2537Å) \rightarrow Hg^* \quad (2)$$

where h = Planck's constant
c = speed of light
λ = wavelength of absorbed radiation (3)

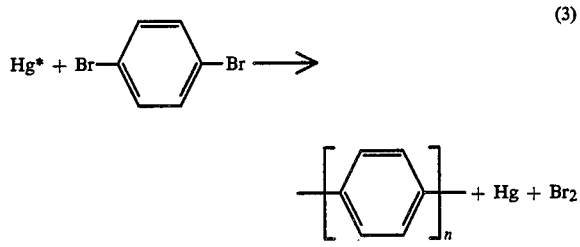

where n = degree of polymerization.

Mercury vapor is introduced into the reaction chamber by passing either the vapor phase monomer or an inert carrier gas, such as nitrogen or argon, through a room temperature vessel containing liquid mercury and mercury vapor above it (i.e. at a vapor pressure of about $10^{-3}$ torr or 0.1 pascals). The mercury-sensitized photolysis process has the advantage that higher deposition rates are obtained. However, the direct photolysis process has the advantage that possible mercury contamination of the product is avoided. In addition, while mercury is used as a photosensitizer in conjunction with radiation from a low pressure mercury vapor lamp, other photosensitizers, such as cadmium, zinc, or xenon, may be used in conjunction with radiation having a wavelength corresponding to the absorption wavelength for that element. A medium pressure mercury vapor lamp may be used to provide a higher intensity output than a low pressure lamp and would be useful in conjunction with sensitizers other than mercury or for direct photolysis.

Since the chemical reaction in the process of the present invention is produced by radiation inducement, heat is not required to effect the reaction for producing the polyparaphenylene of the present invention. Some heat is, however, required in order to convert the monomer from the solid or liquid phase to the vapor phase. In the case of dibromobenzene, a monomer source temperature of 65° C. may be sufficient, and in the case of diiodobenzene, a monomer source temperature of 115° C. may be sufficient. In these cases, a substrate temperature of at least 65° C. and 115° C., respectively, may be needed for the substrate. However, such temperatures are substantially lower than those used in known methods for sintering powdered polyparaphenylene (e.g. 300° to 400° C.) into sheet form. Typically, the process of the present invention is performed at a monomer source temperature in the range of 30° C. to 120° C. Higher temperatures may be used to increase the monomer vapor pressure in conjunction with equally high or higher substrate temperatures to prevent monomeric vapor condensation and subsequent loss of polymeric film uniformity. Similarly, with a fixed partial pressure, temperatures lower than 30° C. for the substrate may enhance the deposition rate if the monomer source temperature is also lower than the substrate temperature. In addition, in order to prevent formation of the polymer or condensation of the monomer on the quartz window of the reaction chamber, which would decrease the amount of reaction-inducing radiation entering the chamber, the window is maintained at a temperature about 100° C. higher than the substrate.

The operating pressure in the photochemical vapor deposition chamber for the process of the present invention is typically within the range of about 0.1 to 1 torr (15 to 150 pascals), although higher or lower pressures may be used if required. The operating pressure must be sufficiently low so that the monomer vapor will not condense to the solid or liquid state and that a suitable mean free path for the activated reactive species and an acceptable rate of reaction are provided. The length of time required to deposit a polymer layer in accordance with the present invention depends on, among other things, the layer thickness and the deposition rate, and may vary from about 1 to 6 hours. The rate of deposition is dependent on the temperature of the substrate, the intensity of the reaction-inducing radiation, the concentration of the reactants, and the flow rates of the reactants.

A series of polyparaphenylene depositions were performed on a silicon substrate using p-dibromobenzene and diiodobenzene as the monomer precursors, as described in greater detail in the Examples herein. Samples 2700Å thick were obtained and were found to have a calculated refractive index (uncorrected for absorption) of between 1.7 and 1.9, as compared to the refractive index of 1.97 for commercially available, low molecular weight polyparaphenylene obtained from Allied Chemical, and dip coated onto a silicon substrate. The deposited films were vacuum baked at 425° C. and exhibited no change in thickness and only a slight decrease in refractive index. Thus, the product of the first embodiment of the present invention has a thermal stability which is indicative of polyparaphenylene and which eliminates identification of the product as a structure which is primarily aliphatic or polyphenylene oxide. In addition, polyparaphenylene may be readily distinguished from polyparaphenylene oxide since a deposit of the former is light-absorbing (i.e. dark) and a deposit of the latter is transparent. The resistivity of these deposited films of the present invention was measured to be as high as $5\times10^{14}$ ohm-cm. The dielectric strength was measured to be $2\times10^{5}$ volts/centimeter and a dielectric constant of about 2.5 was measured at 100 kilohertz. All of these measurements indicate a good insulator that is relatively pinhole-free. Further, when a film of this material was subsequently doped with antimony pentafluoride, as discussed herein below, a conductive polymer was formed. The latter result demonstrates the conjugated nature of the polymer formed in accordance with the first process embodiment of the present invention, as also discussed below with regard to the second process embodiment of the present invention. In addition, the films were strongly absorbent of visible and untraviolet light, which is also indicative of the conjugated structure of the present polymer. The polyparaphenylene films were insoluble in organic solvents, such as acetone, methanol, and propanol, which indicates a very high molecular weight polymer with possible cross-linking. Visual examination indicated a good conformal coating with good step coverage.

Thus, in accordance with the first process embodiment of the present invention there is provided a polyphenylene layer which is a good insulator or surface passivation material for semiconductor devices and circuits. Furthermore, the polyphenylene layer of the present invention is produced by a low-temperature process (e.g 30° C. to 120° C.) which avoids or minimizes thermal damage to the substrate and makes the process of this invention particularly well suited for use on temperature-sensitive substrates, such as low-melting metals, certain compound semiconductor materials, certain plastics, and semiconductor device substrates having predefined dopant regions. In particular, the polyparaphenylene formed in accordance with the present invention can provide an oxygen-free passivation dielectric layer for a gallium arsenide device, since the formation of oxide states at the interface, as occurs in prior art passivation techniques, is avoided in the present invention. Further, the controlled energy of ultraviolet radiation in the photochemical vapor deposition process of the present invention permits retention of monomeric properties in the resulting polymeric films. By contrast, higher energy techniques, such as plasma enhanced chemical vapor deposition, as described, for example, by H. Carchano, in *J. Chem. Phys.*, Vol. 61, 1974, at page 3634, destroy the monomer unit structure and deposit polymers from virtually random hydrocarbon fragments. Moreover, the process of the present invention may be used to polymerize vapors of materials which cannot be polymerized by conventional techniques. In addition, the photochemical vapor deposition process of the present invention is well suited for thin film applications in sensitive semiconductor device and integrated circuit fabrication, whereas conventional polymerization techniques are incompatible with the process limitations of such fabrication. Further, the process of the present invention provides a means for forming thin films of polyparaphenylene, whereas such thin films could not be formed by prior art methods of sintering and forming such polymers. Thus, the process of the present invention provides a uniform, conformal coating of aromatic polymers with controllable molecular structure, particularly well suited for thin film applications.

Turning now to the second process embodiment of the present invention, there is provided a low-temperature process for forming a conductive polymer. The polyphenylene layer formed in accordance with the first process embodiment of the present invention is doped with a selected material which produces conductivity in the polymer film. Conventional doping techniques such as diffusion from vapors or electrolytic solutions may be used as generally described by D. M. Ivory et al, *J. Chem. Phys.*, Vol. 71, 1979, at page 1506. Suitable dopant materials include electron donors and electron acceptors derived from species such as antimony pentafluoride ($SbF_5$), arsenic pentafluoride ($AsF_5$), boron trifluoride ($BF_3$), perchloric acid ($HClO_4$), iodine ($I_2$), bromine ($Br_2$), and alkali metal salts. While the mechanism by which doped polymers are changed from insulators to conductors is only vaguely understood, it is generally accepted that a charge transfer takes place between the polymer and the dopant to give rise to an ion delocalized along the polymeric chain and a localized dopant counter ion. This theory is discussed by J. Mort in the publication in *Science*, Vol. 208, 1980, at page 819 et seq. In addition, it is known that a conjugated polymeric structure is necessary for conductivity. Thus, in accordance with the first process embodiment of the present invention, the monomeric unit is appropriately chosen to provide the desired conjugated structure in the polymer product. Parasubstituted monomers are preferred for this purpose.

In accordance with the second process embodiment of this invention, a test structure was formed by depositing a layer of polyphenylene on a comb pattern of interdigitated gold on an aluminum oxide substrate in accordance with the first process embodiment of the present invention using p-diiodomobenzene as the monomer and mercury-sensitized photolysis with 2537Å radiation. The film was 1100Å thick and had an initially measured electrical conductivity of less than about $10^{-12}$ (ohm-cm)$^{-1}$, the lowest detectable conductivity. The electrical conductivity was determined by measuring the resistance between the fingers of interdigitated comb patterns. Liquid antimony pentafluoride ($SbF_5$) was placed in a room temperature chamber external to the reaction chamber. The vapors of $SbF_5$ formed at room temperature were driven into the reaction chamber under their own vapor pressure. The film was exposed to the $SbF_5$ vapors for several minutes, after which the excess $SbF_5$ was removed by dynamic pumping under vacuum. The doped polymer layer was found to have an electrical conductivity of about $10^{-5}$ (ohm-cm)$^{-1}$, thus increasing the relative conductivity of this layer over seven orders of magnitude. The electrical conductivity was measured in situ in the absence of oxygen and moisture in order to avoid degradation of the polymer, as is known in the art to occur in polyparaphenylene. After one hour of applied vacuum, the conductivity of the doped polymer layer decreased to and stabilized at $10^{-6}$ (ohm-cm)$^{-1}$, perhaps due to out-gassing of the dopant or degradation caused by residual moisture or oxygen in the chamber. Thus, the second process embodiment of the present invention provides a low-temperature process for forming a conductive polymer. In addition, these test results demonstrate the conjugated nature of the polymer formed in accordance with the first process embodiment of the present invention.

As previously discussed, conductive polymers are useful for forming lightweight batteries, solar cells, wire and cable sheathing and electromagnetic shielding.

Finally, in accordance with a third process embodiment of the present invention, there is provided a low-temperature process for forming a conductive polymer by simultaneous polymerization and doping. The process according to the first embodiment of the present invention is followed except that the monomer is exposed to radiation in the presence of a vapor phase dopant material. Suitable dopant materials are those described with respect to the second embodiment of the present invention, and the dopant vapors are introduced into the reaction chamber as previously described. Thus, in accordance with the third process embodiment of this invention, the polymer is doped in-situ during the formation and deposition of the polymer, and a separate doping step is eliminated. In addition, depending on bond energies, the in-situ doping process may involve photochemical activation of the dopant species, which may, in turn, enhance the formation of polymeric ions and dopant counter ions. One possible mechanism for the formation of polyparaphenylene doped with antimony pentafluoride may be as shown in equation (4), in which the dopant molecules react with the monomer precursor to form localized negative ions and positive charges that are delocalized along the chain of length equal to n+m units. In equation (4), the "+" charge is delocalized along the polymer chain.

(4)

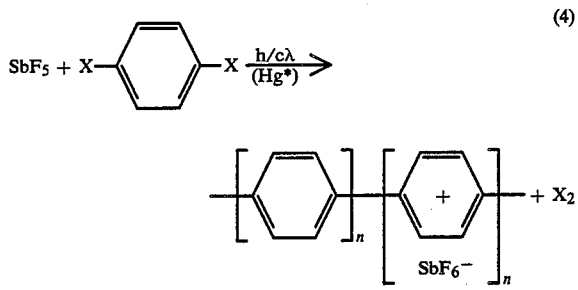

Further, by the in-situ doping process, uniform incorporation and control of the dopant species can be achieved, resulting in enhanced conductivity and stability of the conductive polymer produced.

EXAMPLE 1

This example illustrates the formation of a layer of polyparaphenylene in accordance with the first process embodiment of the present invention as previously described in detail and as summarized in Table I. A known photochemical vapor deposition system, as generally described in U.S. Pat. No. 4,371,587 was used. The substrate was a chip, one-inch (2.54 cm) by three-inch (7.62 cm), from a silicon wafer. The monomer precursor was p-diiodobenzene. Mercury-sensitized photolysis was used, with radiation at 2537Å being provided by a low pressure mercury vapor lamp at an intensity on the substrate of about 10 milliwatts/cm$^2$. About 10 grams of p-diiodobenzene were placed in a vial having an opening about ⅜ inch (0.95 cm) in diameter. The vial was wrapped in aluminum foil and closed with a small porous plug of glass wool to hold the crystals within the vial and allow the vapor to escape. The vial was secured to the substrate holder with the opening of the vial at a distance of about one inch (2.54 cm) from the substrate. The reaction chamber was evacuated, and the substrate holder was heated to about 115° C. The pressure in the chamber was adjusted to 0.2 torr by partially closing the gate valve to the pump. The mercury vapor photosensitizer was introduced into the reaction chamber with a nitrogen carrier gas. After the system had stabilized, the ultraviolet lamps were turned on and the reaction initiated.

Polymer deposition was evident within 45 minutes when a yellow color appeared on the wafer. Deposition was continued until all of the p-diiodobenzene had sublimed away (as indicated by a sudden drop in vapor pressure in the reaction chamber), which took about 1.6 hours, as indicated in Example 1a of Table I. The deposited film was measured by ellipsometry and had a maximum thickness of 1100Å. The refractive index was found to be 1.76, as measured by ellipsometry. Visual examination revealed that the film was continuous and adherent to the substrate. A post-deposition heat-treatment at 100° C. under high vacuum did not affect the deposited film. As previously discussed, both the thermal conductivity and the amenability to being converted to a conductive polymer by doping indicate that this polymer is predominantly polyparaphenylene.

The process described above was repeated on a second silicon wafer for 1.7 hours as indicated in Example 1b in Table I, to form a deposited layer having a thickness of 850Å. The dielectric constant of the deposited layer was measured to be 2.5 at 100 kilohertz, using a test capacitor structure.

TABLE I

PHOTO-CVD AROMATIC POLYMERS

| Example No. | Monomer | Conditions | Results (Thickness; refractive index) |
|---|---|---|---|
| 1a | p-diiodobenzene | 1.6 hr/115° C./S | 1100Å; n = 1.76 |
| 1b | p-diiodobenzene | 1.7 hr/115° C./S | 850Å; n = 1.80 |
| 1c | p-diiodobenzene | 20 hr/115° C./S | 5000–7000Å; n = 1.7–1.9 |
| 2a | p-dibromobenzene | 3.67 hr/65° C./S | 850Å; n = 1.75 |
| 2b | p-dibromobenzene | 7.75 hr/85° C./S | 2800Å; n = 1.85–1.90 |
| 3 | p-dibromobenzene | 5.75 hr/85° C./D | 1100Å; n = 1.78 |
| 4 | bromobenzene | 2.9 hr/45° C./D | 880Å; n = 1.91 |
| 5 | m-xylene | 1.5 hr/45° C./D | 165Å; |

D = direct photolysis
S = mercury-sensitized photolysis

The process described above was repeated on a third silicon wafer as indicated in Example 1c in Table I. The monomer source was incrementally replenished to obtain a total deposition time of 20 hours and to form a deposited layer having a thickness of 5000 to 7000 angstroms.

EXAMPLE 2–5

The process described in Example 1 was followed except that the monomer used and the reaction conditions were as indicated in Table I. The solid monomer p-dibromobenzene was handled as described in Example 1. The remaining monomers listed in Table I are liquids and were placed in external containers at room temperature. The reaction conditions and results are also indicated in Table I, where "D" indicates direct photolysis with 1849Å radiation and "S" indicates mercury-sensitized photolysis with 2537Å radiation as previously described.

EXAMPLE 6

This example illustrates the formation of a layer of a conductive polymer in accordance with the second process embodiment of the present invention as previously described in detail.

The layer of polyparaphenylene deposited in Example 1a was used as the starting material. The electrical conductivity of the coated wafer was calculated from the resistance between the fingers of the comb pattern and was found to be greater than $10^{-12}$ (ohm-cm)$^{-1}$.

The coated wafer was then exposed for several minutes to $SbF_5$ vapors formed by placing liquid $SbF_5$ in a chamber at room temperature and external to the reaction chamber, and introducing the vapors into the reaction chamber under their own pressure. Then, the excess $SbF_5$ was removed by dynamic pumping under vacuum. The electrical conductivity of the doped film was measured as described above and found to be $10^{-5}$ (ohm-cm)$^{-1}$. The wafer was subjected to one hour of applied vacuum and the conductivity was found to stabilize at $10^{-6}$ (ohm-cm)$^{-1}$.

EXAMPLE 7

This example illustrates the formation of a layer of a conductive polymer in accordance with the third process embodiment of the present invention.

The process described in Example 1 is followed except that in addition to the p-diiodobenzene vapors generated in the reaction chamber, $SbF_5$ vapors are also introduced into the reaction chamber. The $SbF_5$ vapors are generated by liquid $SbF_5$ at room temperature in a container external to the reaction chamber to produce a vapor phase, and then the $SbF_5$ vapors may be introduced into the reaction chamber, either swept with a carrier gas, such as nitrogen, or driven by their own vapor pressure. Upon activation of the radiation source, the photochemical vapor deposition reaction proceeds, producing a thin film of $SbF_5$-doped polyparaphenylene on the substrate.

Having thus described exemplary embodiments of the present invention, it should be noted by those skilled in the art that the disclosures within are exemplary only and that various other alternatives, adaptations, and modifications may be made within the scope of the present invention. Accordingly, the present invention is not limited to the specific embodiments as illustrated herein.

What is claimed is:

1. A process for forming on the surface of a substrate a layer of a chosen organic polymer comprising directly bonded repeating arylene groups, comprising exposing said substrate to a selected vapor phase reactant comprising said arylene group having substituted thereon an element or radical capable of being photodissociated from said arylene group, and radiation of a predetermined wavelength to bring about the photodissociation of said element or radical from said arylene group and the formation of said chosen polymer which deposits on said surface of said substrate, wherein said polymer is substantially free of said element or radical.

2. The process of claim 1 wherein said vapor phase reactant comprises a dihalogenated aromatic compound.

3. The process of claim 2 wherein said vapor phase reactant comprises a dihalogenated benzene compound.

4. The process of claim 1 wherein:

(a) said exposing occurs in the presence of mercury vapors as a photosensitizer; and (b) said radiation is provided by a low pressure mercury vapor lamp.

5. The process of claim 4 wherein said vapor phase reactant comprises p-diiodobenzene, said predetermined wavelength is approximately 2537 angstroms, and said polymer comprises polyparaphenylene.

6. The process of claim 1 wherein said vapor phase reactant is p-dibromobenzene and said predetermined wavelength is 1849 angstroms and said polymer comprises polyparaphenylene.

7. The process of claim 1 wherein said vapor phase reactant is m-xylene and said predetermined wavelength of radiation is 1849 angstroms.

8. A process for forming on the surface of a substrate a layer of a chosen conductive polymer comprising directly bonded repeating arylene groups and a selected dopant comprising the steps of:

(a) exposing said substrate to a selected vapor phase reactant comprising said arylene group having substituted thereon an element or radical capable of being photodissociated from said arylene group, and radiation of a predetermined wavelength to bring about the photodissociation of said element or radical from said arylene group and the formation of an undoped polymer comprising directly bonded repeating arylene groups, which deposits as a layer on said surface of said substrate wherein said polymer is substantially free of said element or radical; and (b) introducing a selected dopant material into said layer of said undoped polymer to thereby form said conductive polymer.

9. The process of claim 8 wherein said vapor phase reactant comprises a dihalogenated aromatic compound.

10. The process of claim 9 wherein said vapor phase reactant comprises diiodobenzene.

11. The process of claim 8 wherein said dopant material is selected from the group consisting of antimony pentafluoride, arsenic pentafluoride, boron trifluoride, perchloric acid, iodine, bromine, and an alkali metal salt.

12. The process of claim 8 wherein:

(a) said vapor phase reactant is p-diiodobenzene;

(b) said exposing occurs in the presence of mercury vapors as a photosensitizer;

(c) said predetermined wavelength is 2537 angstroms;

(d) said polymer comprises polyparaphenylene; and (e) said dopant material comprises antimony pentafluoride.

13. A process for forming on the surface of a substrate a layer of a chosen conductive polymer comprising directly bonded arylene groups and a selected dopant, comprising exposing said substrate to a selected vapor phase reactant comprising the monomer precursor of said repeating arylene groups and a selected vapor phase dopant material in the presence of radiation of a predetermined wavelength to bring about the formation of said conductive polymer.

14. The process of claim 13 wherein:

(a) said monomer precursor is p-diiodobenzene; and (b) said dopant material is vapor phase antimony pentafluoride.

* * * * *

UNITED STATES PATENT AND TRADEMARK OFFICE

CERTIFICATE OF CORRECTION

PATENT NO. : 4,588,609

DATED : May 13, 1986

INVENTOR(S) : Richard N. Leyden and James T. Hall

It is certified that error appears in the above—identified patent and that said Letters Patent is hereby corrected as shown below:

Title Page

After "Inventor", insert

--Assignee: Hughes Aircraft Company,
El Segundo, California--

After "Primary Examiner", insert

--Attorney, Agent, or Firm - Mary E. Lachman;
A.W. Karambelas--

Column 8, line 53, in Equation (4),

Delete "n" and insert therefor --m--

Signed and Sealed this

Tenth Day of November, 1987

*Attest:*

*Attesting Officer*

DONALD J. QUIGG

*Commissioner of Patents and Trademarks*